US007434566B2

(12) United States Patent
McKay et al.

(10) Patent No.: US 7,434,566 B2
(45) Date of Patent: Oct. 14, 2008

(54) ETC CONTROL SYSTEM AND METHOD

(75) Inventors: Daniel L. McKay, Brighton, MI (US); Gary A. Nichols, Farmington Hills, MI (US); Carelton Williams Guillaume, Belleville, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/590,304

(22) Filed: Oct. 31, 2006

(65) Prior Publication Data

US 2008/0098986 A1 May 1, 2008

(51) Int. Cl.
*F02D 11/10* (2006.01)
*F02D 9/08* (2006.01)

(52) U.S. Cl. ..... 123/399; 123/337

(58) Field of Classification Search ..... 123/399, 123/337; 73/118.2

See application file for complete search history.

(56) References Cited

U.S. PATENT DOCUMENTS 5,078,110 A 1/1992 Rodefeld
6,167,866 B1 * 1/2001 Jakisch et al. ..... 123/396
6,345,604 B1 * 2/2002 Ahrns et al. ..... 123/398
6,431,144 B1 * 8/2002 Daly ..... 123/399
6,786,199 B2 * 9/2004 Oda et al. ..... 123/399
7,111,610 B2 9/2006 Nidigattu
7,114,487 B2 * 10/2006 Hedrick et al. ..... 123/399
7,159,563 B1 * 1/2007 Garrick ..... 123/399
7,210,452 B2 * 5/2007 Nakashima et al. ..... 123/399
2004/0182370 A1 * 9/2004 Parkinson et al. ..... 123/549
2005/0155574 A1 7/2005 Hedrick et al.
2006/0037473 A1 * 2/2006 Kunath et al. ..... 95/117
2007/0084438 A1 * 4/2007 Garrick et al. ..... 123/396

FOREIGN PATENT DOCUMENTS

JP 11-341873 * 12/1999

* cited by examiner

*Primary Examiner*—Hai H Huynh
(74) *Attorney, Agent, or Firm*—Paul L. Marshall

(57) ABSTRACT

An electronic throttle control system and method which prevents obstructions from forming around a throttle plate during engine soak.

9 Claims, 1 Drawing Sheet

ETC CONTROL SYSTEM AND METHOD

TECHNICAL FIELD

The present invention relates to electronic throttle control (ETC) systems, and more particularly to ETC systems and methods for clearing water, ice or other matter from around a throttle plate during engine soak.

BACKGROUND OF THE INVENTION

Electronic throttle controls or "ETCs" are well known for controlling the movement of a throttle plate within a throttle body that operates to control the amount of air delivered to an internal combustion engine. The ETC receives signals from the engine and/or the electronic control unit (ECU) of the vehicle directing the ETC to move the throttle plate to a degree dictated by the air requirements of the engine condition. It is also known that the throttle plate may sometimes become stuck due to icing or coke formation, for example. When this occurs, the ETC sets throttle actuation faults directing the throttle blade to move to a slightly open position which allows only enough air to reach the engine for a "limp home" condition. If the throttle is stuck in a near or fully open position, the ETC system detects this and reduces the available power to idle only or may completely disable the engine in some cases.

ETC systems have been developed in the past directed toward removing the obstruction from the throttle plate such as seen in commonly owned, co-pending U.S. patent application Ser. No. 11/262,022, the disclosure of which is incorporated herein by reference. In the '022 application, a piezo electronic actuator is disclosed which is operable to apply a high force to the throttle plate gear to free the plate from the stuck position. While the system of the '022 application provides an effective means for freeing a stuck throttle blade, it works from the standpoint that an obstruction has already formed which is preventing the throttle plate from moving correctly. Furthermore, should the obstruction become very large, the force required to free the stuck throttle plate may exceed the maximum force of the piezo actuator.

When an engine is running, the temperature of the engine and surrounding components can be very hot. Once the engine is shut off, the engine begins to cool until it is in equilibrium with the ambient temperature. The period of time from engine shut off to engine temperature equilibrium with the ambient is termed "engine soak" to the those skilled in the art. In cold climates, the engine temperature can thus dip below freezing temperatures as it goes through engine soak. In this situation, any moisture around the throttle plate will freeze and present a potential block to proper throttle movement once the engine is started again. Other matter such as coke can also form around a throttle plate.

There therefore exists a need for an ETC system and method directed at clearing potential or partly formed obstructions near the throttle plate during engine soak.

SUMMARY OF THE INVENTION

The present invention successfully addresses the above stated need by providing an ETC system and method which operates when the engine is off and during engine soak by detecting freezing or near-freezing temperatures and responding by moving the throttle blade to clear any water and ice crystals which may have accumulated near the throttle plate. This clearing function may be done at selected intervals for a predetermined period of time as described in more detail below.

BRIEF DESCRIPTION OF THE DRAWINGS

The present invention will now be described, by way of example, with reference to the accompanying drawings, in which.

DETAILED DESCRIPTION

Figure 1:
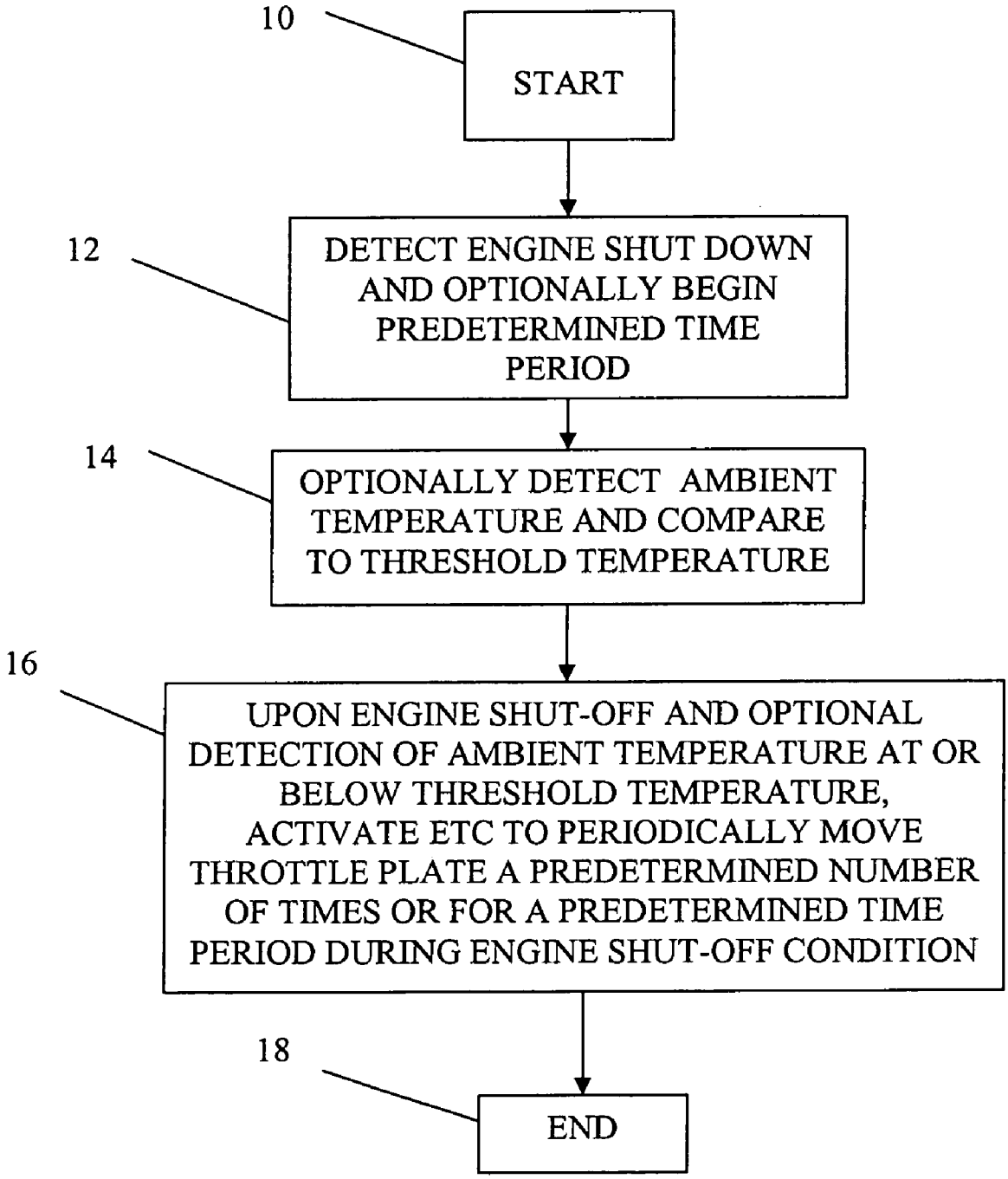
FIG. 1 is a flow diagram illustrating the basic steps involved in accordance with the invention.

Referring to FIG. 1, the basic steps of the inventive system and method is seen for clearing water, ice or other potential obstructions near the throttle plate of a throttle body via the ETC of a vehicle (not shown). As is well known, the ETC is programmed to operate the throttle which provides air to a vehicle engine in amounts dictated by the engine condition. The system and method starts at block and proceeds by detecting an "engine off" condition. When the engine is turned off, the ETC begins to shut down to a hibernation mode. Once the engine is off, a timer may be started to measure a predetermined time period as indicated at block 12. The time period is chosen according to the expected stabilization soak time of the vehicle engine, i.e., the time period following engine shut off required for the throttle temperature to equalize to the outside temperature. It is during this time period that water may accumulate and then, if the ambient temperature is cold enough, freeze around the throttle plate, thereby creating an obstruction to the proper movement of the throttle plate once the engine is started again. The inventive method periodically "wakes up" the hibernating ECU one or more times which moves the throttle plate during this engine soak time to clear away any water and ice crystals (or other matter) forming around the throttle plate.

In this embodiment of the invention, during the predetermined time period, the ambient temperature or the temperature near the throttle plate is monitored as at block 14. Upon detecting a temperature near or below a threshold temperature such as the freezing temperature of water, a signal is sent (e.g. from the engine control unit or computer) to the ETC causing movement of the throttle plate as shown at block 16. This movement of the throttle blade acts to clear water, ice crystals or other matter (e.g. coke) that may have begun forming around the throttle blade. This movement of the throttle blade thus prevents formation of an obstruction that would otherwise prevent the throttle from operating properly once the engine is started again.

Although this embodiment of the invention operates the throttle clearing function only if the ambient temperature is near or below a threshold temperature, an alternate embodiment of the invention may cause the throttle clearing function to operate at the engine-off condition without detecting and thus regardless of the ambient temperature.

Upon the earlier of the expiration of the predetermined time period or starting of the engine, the throttle clearing function is ended as at block 18. If desired, rather than timing the throttle clearing function, the system may be designed such that the throttle clearing function will cease upon the earlier of a predetermined number of periodic throttle clearing movements or starting of the engine. Once the throttle clearing function has ceased, the ETC may return to its normal engine-off hibernation mode until key-up or engine start. The throttle clearing function resets and reinitiates upon detection of subsequent engine shut-off conditions.

If desired, power consumption may be monitored at the vehicle battery to prevent a near or total battery drainage situation. If the battery condition is low, the function can be disabled so that the battery power is maintained for vehicle operation. The vehicle's Powertrain/Engine electronic control systems may be designed to ensure minimum power drainage caused by the operation of the throttle obstruction clearing system and method.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for clearing water, ice or other matter from around a throttle plate of a throttle body operable to provide air to a vehicle engine, said method comprising the steps of:

a) providing an electronic throttle control operable to control the movement of said throttle plate;

b) detecting an engine-off condition;

c) detecting an ambient temperature and comparing said detected temperature to a predetermined threshold temperature, said predetermined threshold temperature being at or below a freezing temperature of water; and d) upon detecting an engine-off condition and that said ambient temperature is at or below said predetermined threshold temperature, causing said electronic throttle control to move said throttle plate one or more times at selected intervals during said engine-off condition without requiring a predetermined standby time elapse.

2. The method of claim 1 wherein said throttle plate is moved at selected intervals for a predetermined period of time during said engine-off condition.

3. The method of claim 1 wherein said throttle plate is moved a predetermined number of times during said engine-off condition.

4. The method of claim 1 and further comprising the step of:

a) upon detecting a low vehicle engine battery condition, stopping said movement of said throttle.

5. A system for clearing water, ice or other matter around a throttle plate of a throttle body operable to provide air to a vehicle engine, said system comprising:

a) an electronic throttle control operable to control the movement of said throttle plate; and b) a first detector for detecting an engine-off condition;

c) a second detector for detecting an ambient temperature and comparing said detected temperature to a predetermined threshold temperature, said predetermined threshold temperature being at or below a freezing temperature of water;

whereby said electronic throttle control moves said throttle plate at selected intervals during said engine-off condition upon said first detector detecting an engine-off condition and said second detector detecting that said ambient temperature is at or below said predetermined threshold temperature without requiring a predetermined standby time elapse.

6. The system of claim 5 wherein said electronic throttle control moves said throttle plate at selected intervals for a predetermined period of time during said engine-off condition.

7. The system of claim 5 wherein said electronic throttle control moves said throttle plate a predetermined number of times during said engine-off condition.

8. The system of claim 5 and further comprising a detector for detecting a low vehicle battery condition;

whereby further movement of said throttle blade during said engine-off condition is ceased upon detecting said low vehicle battery condition.

9. A method for clearing water, ice or other matter from around a throttle plate of a throttle body operable to provide air to a vehicle engine, said method comprising the steps of:

a) providing an electronic throttle control operable to control the movement of said throttle plate;

b) detecting an engine-off condition;

c) detecting an ambient temperature and comparing said detected temperature to a predetermined threshold temperature, said predetermined threshold temperature being at or below a freezing temperature of water; and d) upon detecting an engine-off condition and that said ambient temperature is at or below said predetermined threshold temperature, causing said electronic throttle control to move said throttle plate a plurality of times at selected intervals during said engine-off condition without requiring a predetermined standby time elapse.

* * * * *